US006684934B1

(12) United States Patent
Cargill et al.

(10) Patent No.: US 6,684,934 B1
(45) Date of Patent: Feb. 3, 2004

(54) COUNTERGRAVITY CASTING METHOD AND APPARATUS

(75) Inventors: Danny L. Cargill, New Ipswich, NH (US); Mark W. Oles, Francestown, NH (US); Robert A. Poole, Bedford, NH (US)

(73) Assignee: Hitchiner Manufacturing Co., Inc., Milford, NH (US)

( * ) Notice: Subject to any disclaimer, the term of this patent is extended or adjusted under 35 U.S.C. 154(b) by 0 days.

(21) Appl. No.: 09/578,136

(22) Filed: May 24, 2000

(51) Int. Cl.[7] ..... B22D 18/06

(52) U.S. Cl. ..... 164/119; 164/255; 164/63

(58) Field of Search ..... 164/119, 122.1, 164/255, 63

(56) References Cited

U.S. PATENT DOCUMENTS

| | | | | |
|---|---|---|---|---|
| 3,863,706 A | | 2/1975 | Chandley et al. | 164/255 |
| 3,900,064 A | | 8/1975 | Chandley et al. | 164/51 |
| 3,955,612 A | | 5/1976 | Schultheiss | 164/62 |
| 4,007,772 A | | 2/1977 | Laedtke et al. | 164/151 |
| 4,027,719 A | | 6/1977 | Strempel | 164/51 |
| 4,421,152 A | | 12/1983 | Shinkawa et al. | 164/258 |
| 4,641,703 A | | 2/1987 | Voss et al. | 164/255 |
| 4,660,623 A | | 4/1987 | Ashton | 164/518 |
| 4,848,439 A | | 7/1989 | Plant | 164/16 |
| 4,989,662 A | | 2/1991 | Sabraw | 164/58.1 |
| 5,042,561 A | * | 8/1991 | Chandley | 164/63 |
| 5,299,619 A | * | 4/1994 | Chandley et al. | 164/53 |
| 5,335,711 A | | 8/1994 | Paine | 164/66.1 |
| 5,509,458 A | | 4/1996 | Onuma et al. | 164/63 |
| 5,590,681 A | | 1/1997 | Schaefer et al. | 137/375 |
| 5,597,032 A | * | 1/1997 | Merrien | 164/457 |
| 5,607,007 A | * | 3/1997 | Chandley | 164/122.2 |
| 5,662,859 A | | 9/1997 | Noda | 266/94 |
| 5,832,981 A | * | 11/1998 | McDonald et al. | 164/36 |
| 5,948,352 A | * | 9/1999 | Vender Jagt et al. | 266/239 |
| 6,267,920 B1 | * | 7/2001 | Arakawa et al. | 264/570 |

FOREIGN PATENT DOCUMENTS

| | | | |
|---|---|---|---|
| JP | 6-31431 | * | 6/1994 |
| WO | WO 90/15680 | * | 12/1990 |

* cited by examiner

*Primary Examiner*—M. Alexandra Elve
*Assistant Examiner*—Len Tran

(57) ABSTRACT

Countergravity casting of metals and metal alloys provides for melting of the metallic material under subambient pressure, evacuation of a gas permeable or impermeable mold under subambient pressure, and controlled, rapid filling of the mold while it is maintained under the subambient pressure by applying gas pressure locally on the molten metallic material in a sealed space defined by engagement of a mold base and a melting vessel with a seal therebetween. The gas pressure applied locally in the sealed space establishes a differential pressure on the molten metallic material to force it upwardly through the fill tube into the mold.

23 Claims, 14 Drawing Sheets

COUNTERGRAVITY CASTING METHOD AND APPARATUS

FIELD OF THE INVENTION

The present invention relates to countergravity casting of metals and metal alloys.

BACKGROUND OF THE INVENTION

U.S. Pat. Nos. 3,863,706 and 3,900,064 describe countergravity casting process and apparatus which permit the melting of reactive metals and alloys under a vacuum, and the subsequent protection of the melted material by the introduction of an inert gas, such as argon, to a melting chamber. A gas permeable mold is positioned in a mold chamber above and separated by a horizontal isolation valve from the melting chamber. The mold chamber is evacuated and then inert gas, such as argon, is subsequently introduced to the mold chamber to the same pressure as the melting chamber, permitting the opening of the horizontal isolation valve between the mold and melting chambers. The gas permeable mold is lowered to immerse a mold fill tube into the melted material. The mold chamber then is re-evacuated to create a pressure differential sufficient to lift the melted material upwardly through the fill tube into the mold.

In spite of the success of the above countergravity casting process, production experience has identified a number of disadvantages which partially offset its advantages. In particular, the molten metal can not be introduced (countergravity cast) into the mold any more rapidly than the inert gas contained within that mold can be evacuated through its gas permeable wall. Most noticeably, when the molten metal rises beyond approximately two thirds of the height of the mold, the available mold wall surface area through which the remaining gas can be evacuated from the mold diminishes to a point where entry of metal into the top portion of the mold slows significantly. In cast parts with very thin walls, one disadvantage has been a tendency for the relatively slowly moving molten metal, which has lost much of its original superheat during the filling process to that point, to solidify prior to completely filling the cast shape. This results in excessively high rates of scrap in cast parts near the top of the mold, adding cost when prorated over the manufacture of acceptable cast parts.

Moreover, in practice of the above process, removal of reactive gasses from the mold chamber followed by their replacement with inert gas limits exposure of the mold itself to a relatively complete vacuum for only a very brief period of time (e.g. a few seconds). When gas permeable casting molds having interstitial spaces or pores are used in practice of the above process, gasses are trapped in the interstitial spaces or pores within the mold wall. Similarly, when preformed ceramic cores are positioned in the mold to create complex internal passages within a casting, they also have internal porosity which can contain entrapped gas. Exposure of the mold to high levels of vacuum for only a few seconds provides time for some, but not all, of these trapped gas molecules to escape. Backfilling with an inert gas basically reverses the process, pushing the trapped molecules back into the porous areas of the ceramic material. When the mold is filled with liquid metal or alloy, thermal expansion creates a secondary mechanism by which the gas is driven from the interstitial spaces or pores. Particularly when relatively thick castings, or castings containing ceramic cores, are produced using the above process, gas bubbles tend to form as a result of this thermal expansion and sometimes result in internal gas defects in the castings that increase rejection rates at x-ray inspection of the castings, and, occasionally, in external defects which are visually rejected, especially in hot isostatically pressed (HIPped) castings.

An object of the present invention is to provide countergravity casting method and apparatus that overcome the above disadvantages.

SUMMARY OF THE INVENTION

The present invention provides in one embodiment method and apparatus for countergravity casting metals and metal alloys (hereafter metallic material) that provide for melting of the metallic material in a melting vessel under subambient pressure, evacuation of a gas permeable or impermeable mold to a subambient pressure, and controlled, rapid filling of the mold while it is maintained under the subambient pressure by applying gas pressure locally on the molten metallic material in a sealed space defined by engagement of a mold base and the melting vessel with seal means therebetween. The gas pressure applied locally in the sealed space establishes a differential pressure on the molten metallic material to force it upwardly through the fill tube into the mold, which is maintained under subambient pressure.

Pursuant to one particular embodiment of the invention, a metallic material is melted in the melting vessel in a melting compartment under subambient pressure (e.g. vacuum of 10 microns or less). Concurrently, a preheated mold and fill tube are placed on a mold base outside of a casting compartment and then moved into the casting compartment where a mold bonnet is placed on the mold base about the preheated mold such that a mold clamp on the bonnet clamps the preheated mold within the mold base and bonnet. The mold fill tube extends through the mold base. The casting compartment and the mold are evacuated to subambient pressure (e.g. vacuum of 10 microns or less). The melting vessel then is moved into the casting compartment below the mold base. The mold base/bonnet are lowered to immerse the mold fill tube in the molten metallic material and to engage the mold base and the upper end of the melting vessel with a seal therebetween in such a way as to form a sealed gas pressurizable space between the molten metallic material in the melting vessel and the mold base. The mold base is clamped to the melting vessel. The sealed space then is pressurized with inert gas, such as argon, to establish a differential pressure effective to force the molten metallic material upwardly through the fill tube into the mold, while the mold is maintained under the subambient pressure. At the end of the defined time interval, the gas pressurization in the space over the molten melt surface is terminated and subambient pressure in the sealable space and casting compartment is equalized such that any metallic material remaining liquid within the mold drains back into the melting vessel. The mold base is unclamped from the melting vessel and the mold base/bonnet lifted to disengage from the melting vessel and withdraw the fill tube from the molten metallic material. The melting vessel is returned to the melting compartment, and an isolation valve is closed. The casting compartment can then be returned to ambient pressure and then opened, and the mold bonnet can be unclamped and separated from the mold base. The cast mold residing on the mold base then is removed and replaced with a new mold to be cast to repeat the casting cycle.

The present invention is advantageous in that the mold can be maintained under a continuous relative vacuum (e.g. 10 microns or less) prior to and during filling with the molten metallic material to reduce casting defects due to entrapped gas in the mold wall/core body, in that the mold fill rate is controllable and reproducible by virtue of control of positive gas pressure (e.g. up to 2 atmospheres) locally in the sealed space to improve mold filling and reduce casting defects due to inadequate mold fill out, especially in thin walls of the cast component, and to enable taller molds to be filled, and in that efficient utilization of the metallic material is provided in terms of the ratio of the weight of the component being cast relative to the total metallic material consumed during it's manufacture.

The above objects and advantages of the present invention will become more readily apparent from the following detailed description taken with the following drawings.

DESCRIPTION OF THE INVENTION

Figures 1, 1A:
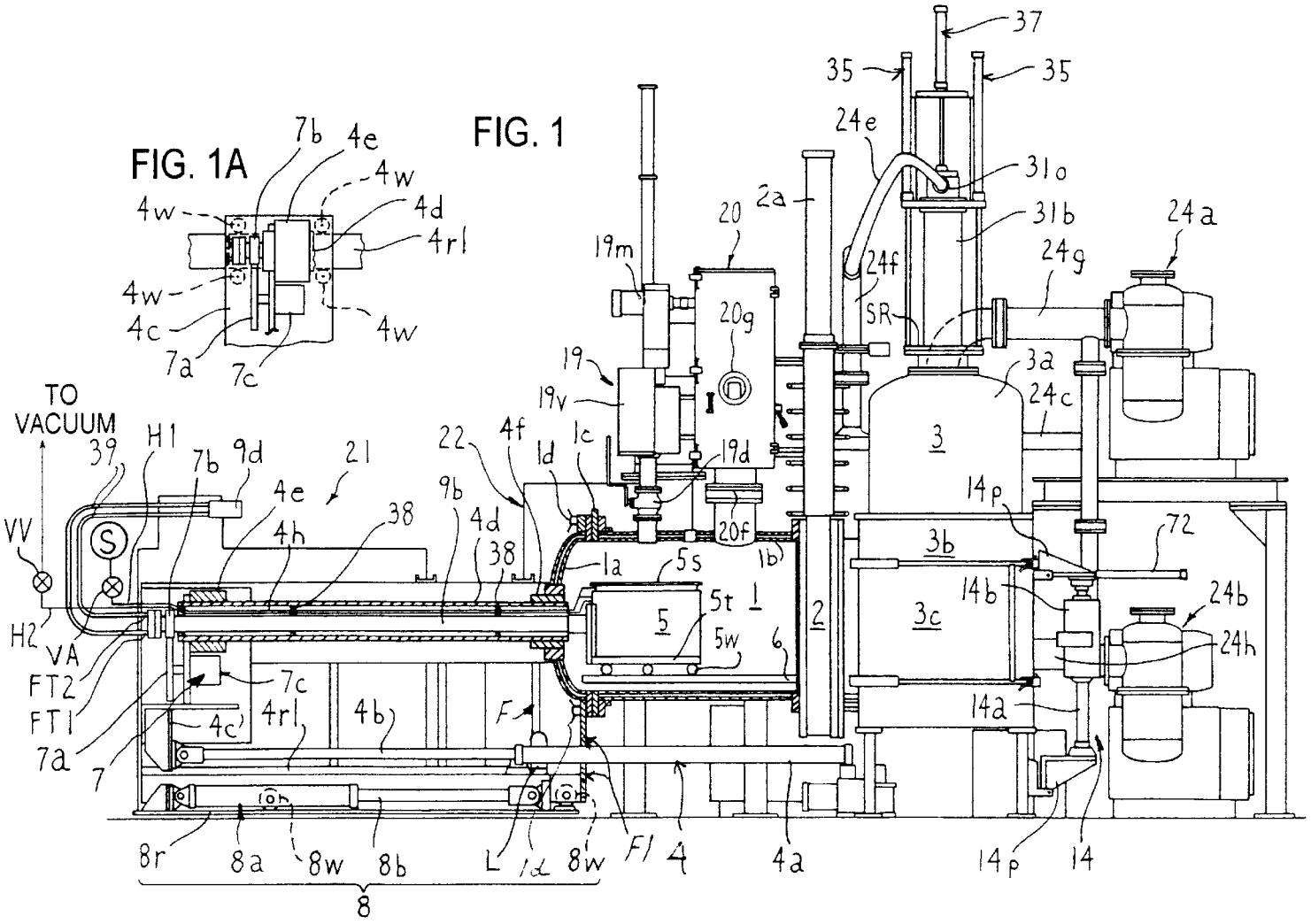
FIG. 1 is an elevational view of apparatus for practicing the invention with certain apparatus components shown in section.
FIG. 1A is a partial elevational view of the wheeled shaft platform with the shaft broken away showing the wheels on a rail located behind the platform adjacent the induction power supply.

FIG. 1 shows a floor level front view of apparatus, with certain components shown in section for purposes of illustration, for practicing an embodiment of the invention for melting and countergravity casting nickel, cobalt and iron base superalloys for purposes of illustration and not limitation. For example, the melting chamber 1 and shaft 4*d* are shown in section for purposes of illustration. The invention is not limited to melting and casting of these particular alloys and can be used to melt and countergravity cast a wide variety of metals and alloys where it is desirable to control exposure of the metal or alloy in the molten state to oxygen and/or nitrogen.

A melting chamber or compartment 1 is connected by a primary isolation valve 2, such as a sliding gate valve, to a casting chamber or compartment 3. The melting compartment 1 comprises a double-walled, water-cooled construction with both walls made of stainless steel. Casting compartment 3 is a mild steel, single wall construction. Shown adjacent to the melting compartment 1 is a melting vessel location control cylinder 4 which moves hollow shaft 4*d* connected to a shunted melting vessel 5 horizontally from the melting compartment 1 into the casting compartment 3 along a pair of tracks 6 (one track shown) that extend from the compartment 1 to the compartment 3.

The melting vessel 5 is disposed on a trolley 5*t* having front, middle, and rear pairs of wheels 5*w* that ride on the tracks 6. The steel frame of the trolley 5*t* is bolted to the melting vessel and to the end of shaft 4*d*. The tracks 6 are interrupted at the isolation valve 2. The interruption in the tracks 6 is narrow enough that the trolley 5*t* can travel over the interruption in the tracks 6 at the isolation valve 2 as it moves between the compartments 1 and 3 without simultaneously disengaging more than one pair of the wheels 5*w*.

The control cylinder 4 includes a cylinder chamber 4*a* fixed to apparatus steel frame F at location L and a cylinder rod 4*b* connected to a wheeled platform structure 4*c* that includes front and rear, upper and lower pairs of wheels 4*w* that ride on a pair of parallel rails 4*r*1 above and below the rails, FIG. 1A and 3. The rails 4*r*1 are located at a level or height corresponding generally to that of shaft 4*d*. In FIG. 1, the rear rail 4*r*1 (nearer power supply 21 shown in FIG. 3) is hidden behind the shaft 4*d* and the front rail 4*r*1 is omitted to reveal the shaft 4*d*. Wheels 4*w* and rail 4*r*1 are shown in FIG. 1A. Hollow shaft 4*d* is slidably and rotatably mounted by a bushing 4*e* at one end of the platform structure 4*c* and by a vacuum-tight bushing 4*f* at the other end in an opening in the dish-shaped end wall 1*a* of melting compartment 1. Linear sliding motion of the hollow shaft 4*d* is imparted by the drive cylinder 4 to move the structure 4*c* on rails 4*r*1.

When the melting compartment 1 has been opened by a hydraulic cylinder 8 powering opening of the dish-shaped end wall 1*a* of the melting compartment to ambient atmosphere, the melting vessel 5 can be disengaged from the trolley tracks 6 and inverted or rotated by a direct drive electric motor and gear drive system 7 disposed on platform structure 4*c*. The rotational electric motor and gear drive system 7 includes a gear 7*a* that drives a gear 7*b* on the hollow shaft 4*d* to effect rotation thereof. Electrical control of the direct drive motor is provided from a hand-held pendent (not shown) by a worker/operator. The melting vessel 5 can be inverted or rotated as necessary to clean, repair or replace the crucible C therein, FIG. 4, or to pour excess molten metallic material from the melting vessel at the end of a casting campaign into a receptacle (not shown) positioned below the crucible.

Figure 4:
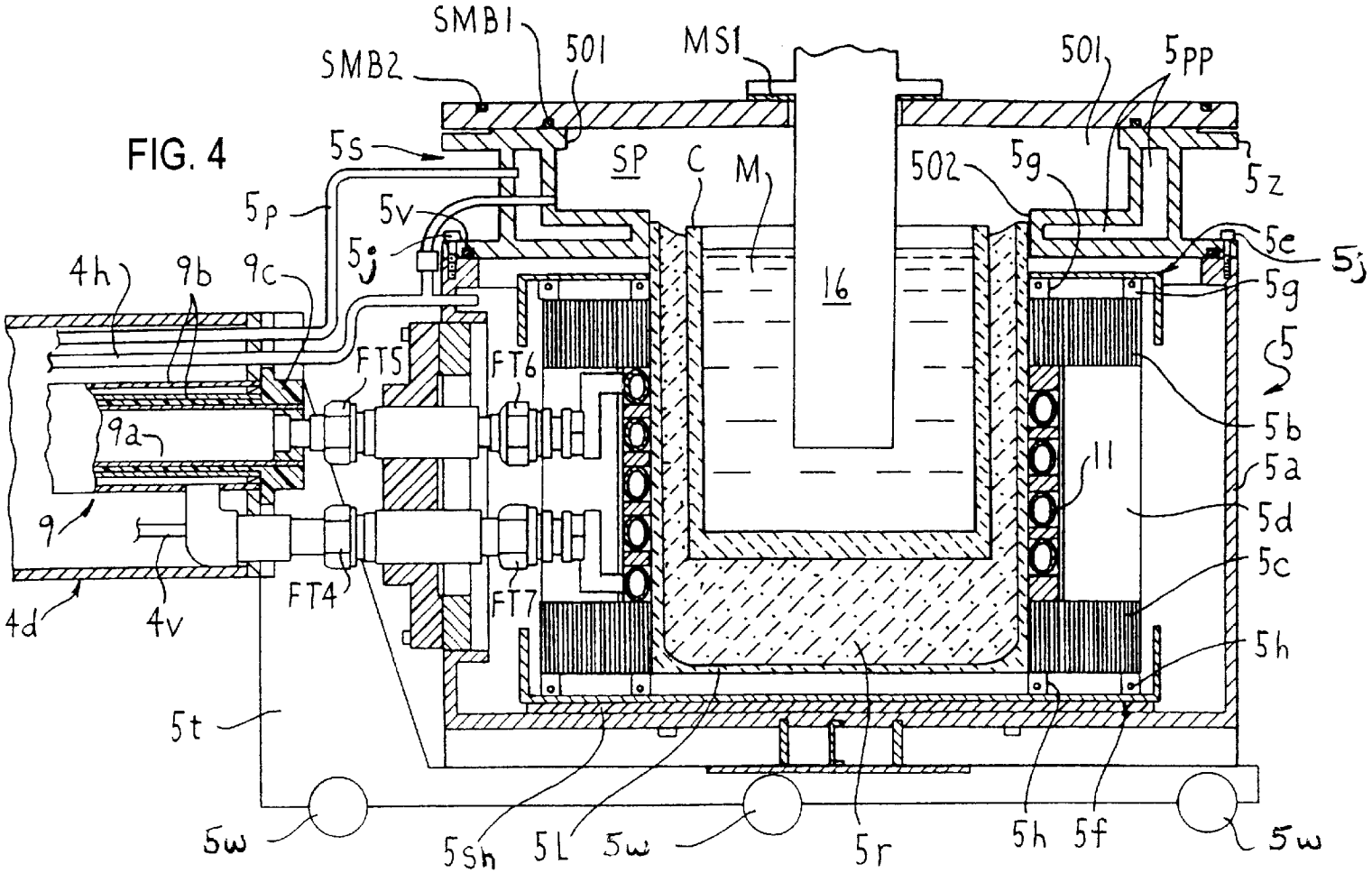
FIG. 4 is a sectional view of the melting vessel taken along the centerline of the shaft with some elements shown in elevation.
Figure 4A:
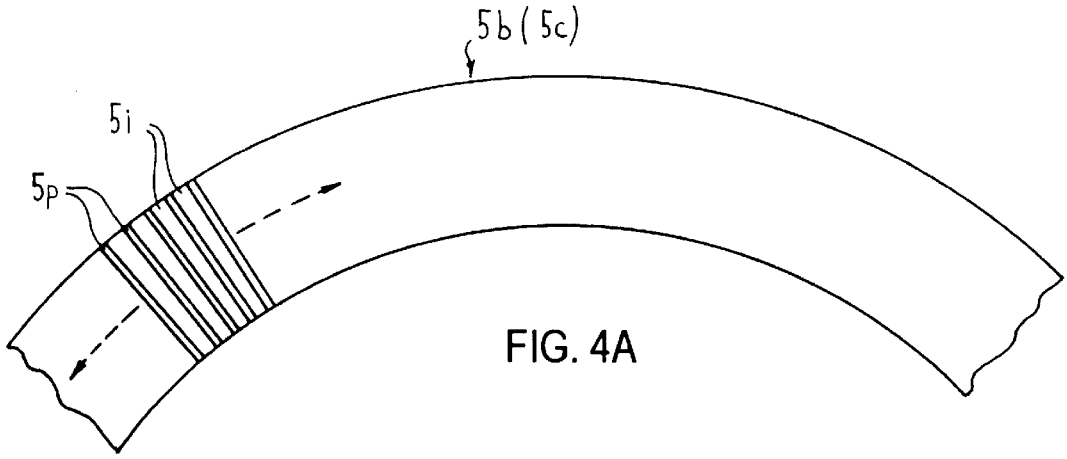
FIGS. 4A and 4B are partial enlarged elevational views of the horizontal shunt ring and a vertical shunt tie-rod member.
Figure 4B:
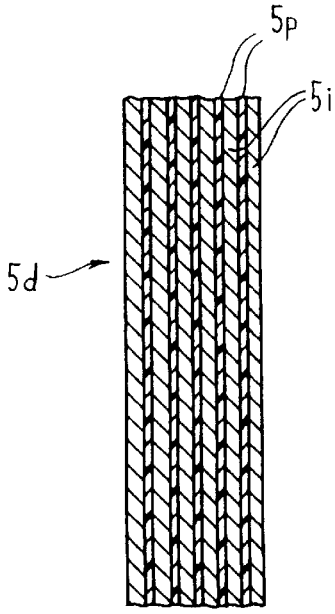

FIGS. 1 and 4 show that hollow shaft 4*d* contains electrical power leads 9 which carry electrical power from a power supply 21 to the melting vessel 5, which contains a water cooled induction coil 11 shown in FIG. 4 in melting vessel 5. The leads 9 are spaced from the hollow shaft 4*d* by electrical insulating spacers 38. Shown in more detail in FIG. 4, the power leads 9 comprise a cylindrical tubular water-cooled inner lead tube 9*a* and an annular outer, hollow, double-walled water-cooled lead tube 9*b* separated by electrical insulating material 9*c*, such as G10 polymer or phenolic, both at the end and along the space between the lead tubes. A cooling water supply passage is defined in the hollow inner lead tube 9*a* and a water return passage is defined in the outer, double-walled lead tube 9*b* to provide both supply and return of cooling water to the induction coil 11 in the melting vessel 5. Returning to FIG. 1, electrical power and water are provided, and exhausted as well, to the power leads 9*a*, 9*b* through flexible water-cooled power cables 39, connected to the outer end of hollow shaft 4*d* and to a bus bar 9*d* to accommodate its motion during operation. The power supply 21 is connected by these power cables to external fittings FT1, FT2 connected to each power lead tube 9*a*, 9*b* at the end of the shaft 4*d*. The electrical power supply includes a three-phase 60 Hz AC power supply that is converted to DC power for supply to the coil 11. The electric motor 7*c* that rotates shaft 4*d* receives electrical power from a flexible power cable (not shown) to accommodate motion of the shaft 4*d*.

Figure 13:
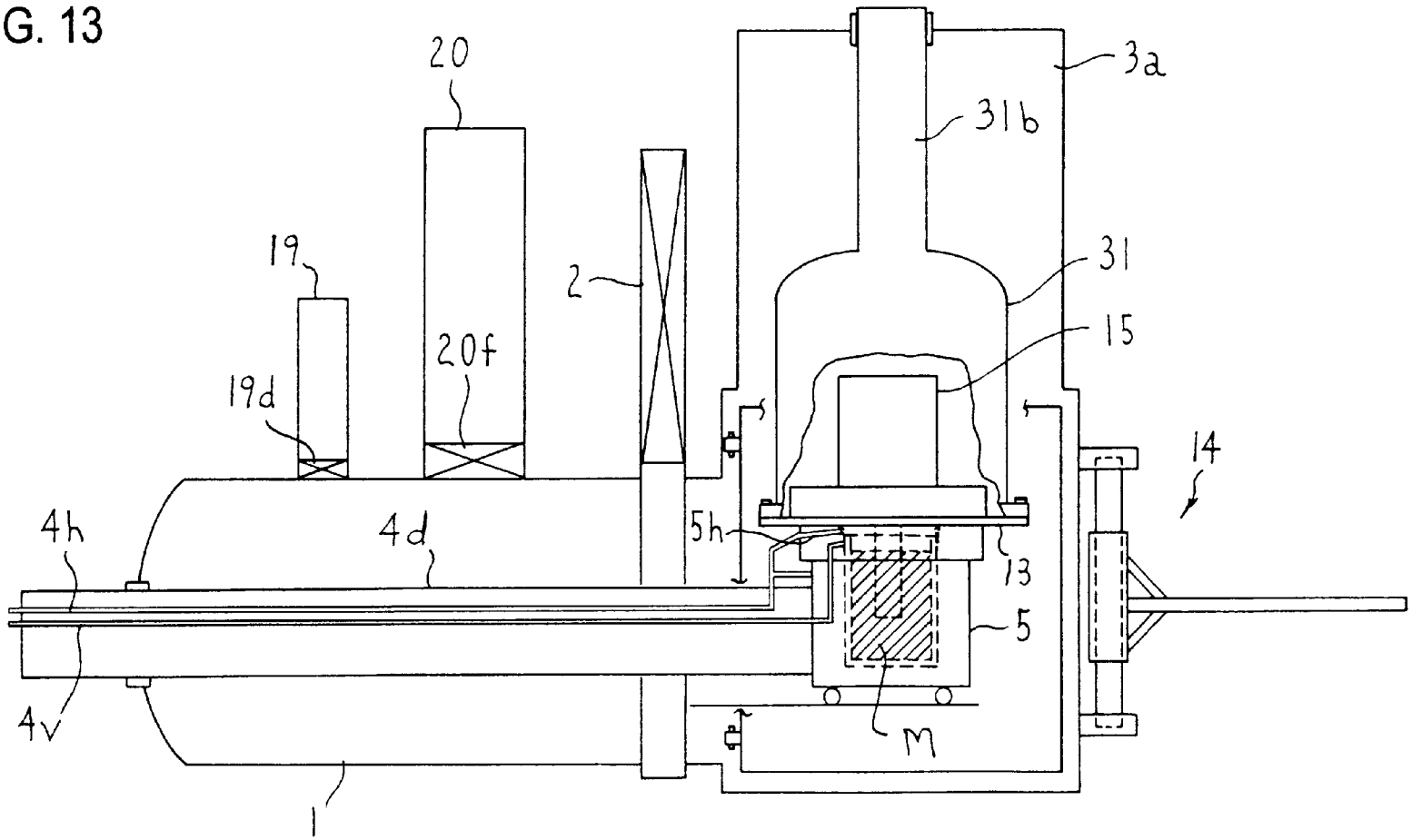

A gas pressurization conduit 4*h*, FIGS. 4 and 13, also is contained in the hollow shaft 4*d* and is connected by a fitting on the end of shaft 4*d* to a source S of pressurized gas, such as a bulk storage tank of argon or other gas that is non-reactive with the metallic material melted in the vessel 5. The conduit 4*h* is connected to the source S through a gas control valve VA by a flexible gas supply hose H1 to accommodate motion of shaft 4*d*. A vaccum conduit 4*v*, FIGS. 4 and 13, also is contained in the hollow shaft 4*d*. Vacuum conduit 4*v* is connected by a fitting on the end of shaft 4*d* to vacuum pumping system 23*a*, 23*b*, and 23*c* via a valve VV and flexible hose H2 at the end of the shaft 4*d* to accommodate motion of shaft 4*d*. The vacuum pumping system 23*a*, 23*b*, and 23*c*, evacuates the melting compartment 1 as described below.

As mentioned above, rotational motion of the melting vessel 5 is provided by direct drive electric motor 7*c* and gears 7*a*, 7*b* of drive system 7 that may be activated when the melting compartment 1 has been opened by the hydraulic cylinder 8 powering such opening. In particular, the cylinder chamber 8*a* is affixed to a pair of parallel rails 8*r* that are firmly mounted to the floor. The cylinder rod 8*b* connects to the rail-mounted movable apparatus frame F at F1 where it connects to the dish-shaped end wall 1*a* of the melting compartment 1. The melting compartment end wall 1*a* can be moved by cylinder 8 horizontally away from main melting compartment wall 1*b* at a vacuum-tight seal 1*c* after clamps 1*d* are released to provide access to the melting compartment; for example, to clean or replace the crucible C in the melting vessel 5. The seal 1*c* remains on melting compartment wall 1*b*. The support frame F and end wall 1*a* are supported by front and rear pairs of wheels 8*w* on parallel rails 8*r* during movement by cylinder 8.

Figure 3:
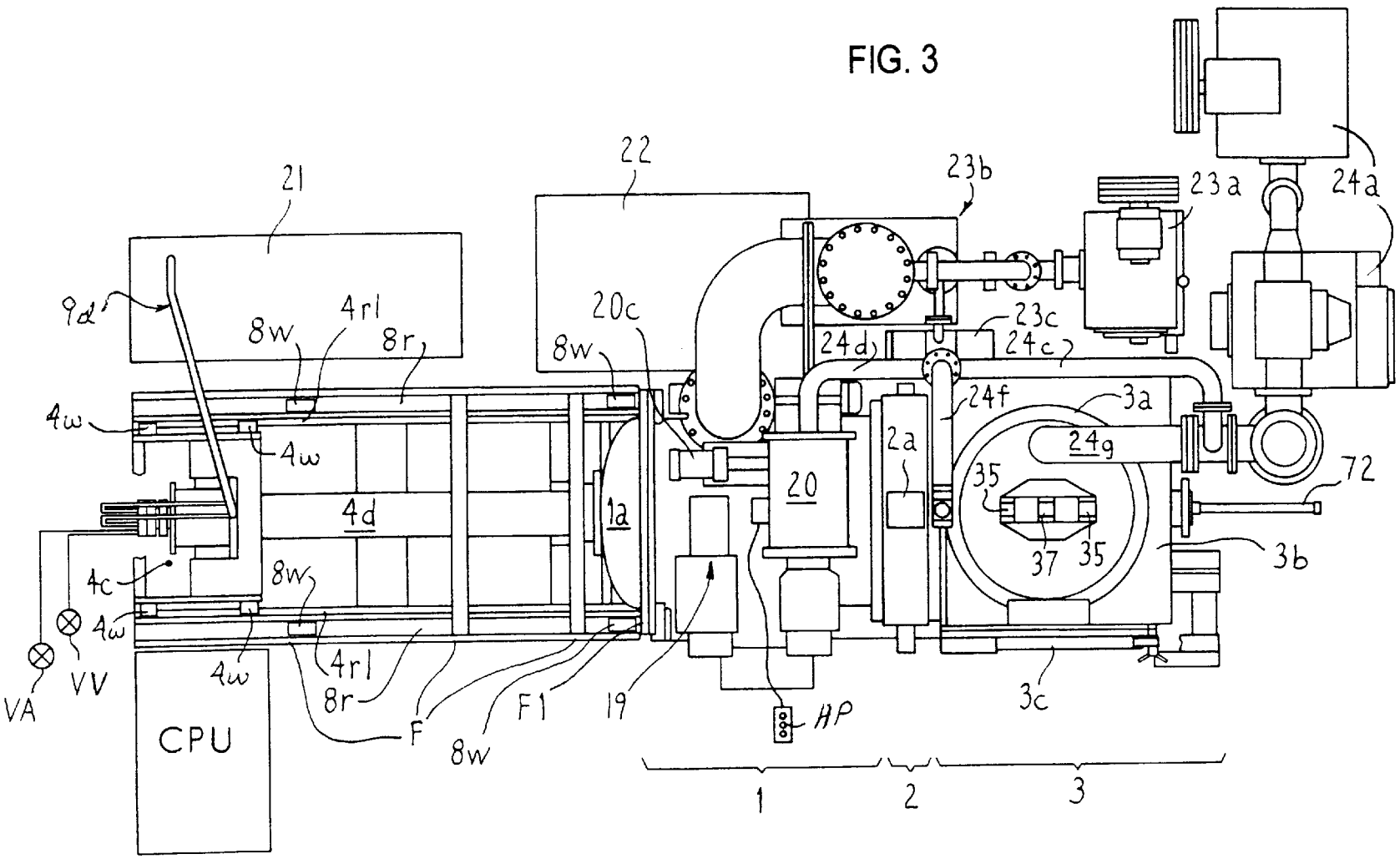
FIG. 3 is a plan view of the apparatus of FIG. 1.

A conventional hydraulic unit 22 is shown in FIGS. 1 and 3 and provides power to all hydraulic elements of the apparatus. The hydraulic unit 22 is located along side the melting compartment 1.

In FIG. 1, conventional vacuum pumping systems 24*a* and 24*b* are shown for evacuating the casting compartment 3 and, as required, all other portions of the apparatus to be described below with the exception of the melting chamber 1. The melting compartment 1 is evacuated by separate conventional vacuum pumping system 23*a*, 23*b* and 23*c* shown in FIG. 3. Operation of the apparatus is controlled by a combination of a conventional operator data control interface, a data storage control unit, and an overall apparatus operating logic and control system represented schematically by CPU in FIG. 3.

The vacuum pumping system 23 for the melting compartment 1 comprises three commercially available pumps to achieve desired negative (subambient) pressure; namely, a Stokes 412 microvac rotary oil-sealed vacuum pump 23*a*, a ring jet booster pump 23*b*, and a rotary vane holidng pump 23*c* operated to provide vacuum level of 50 microns and below (e.g. 10 microns or less) in melting compartment 1 when isolation valve 2 is closed.

Figure 5:
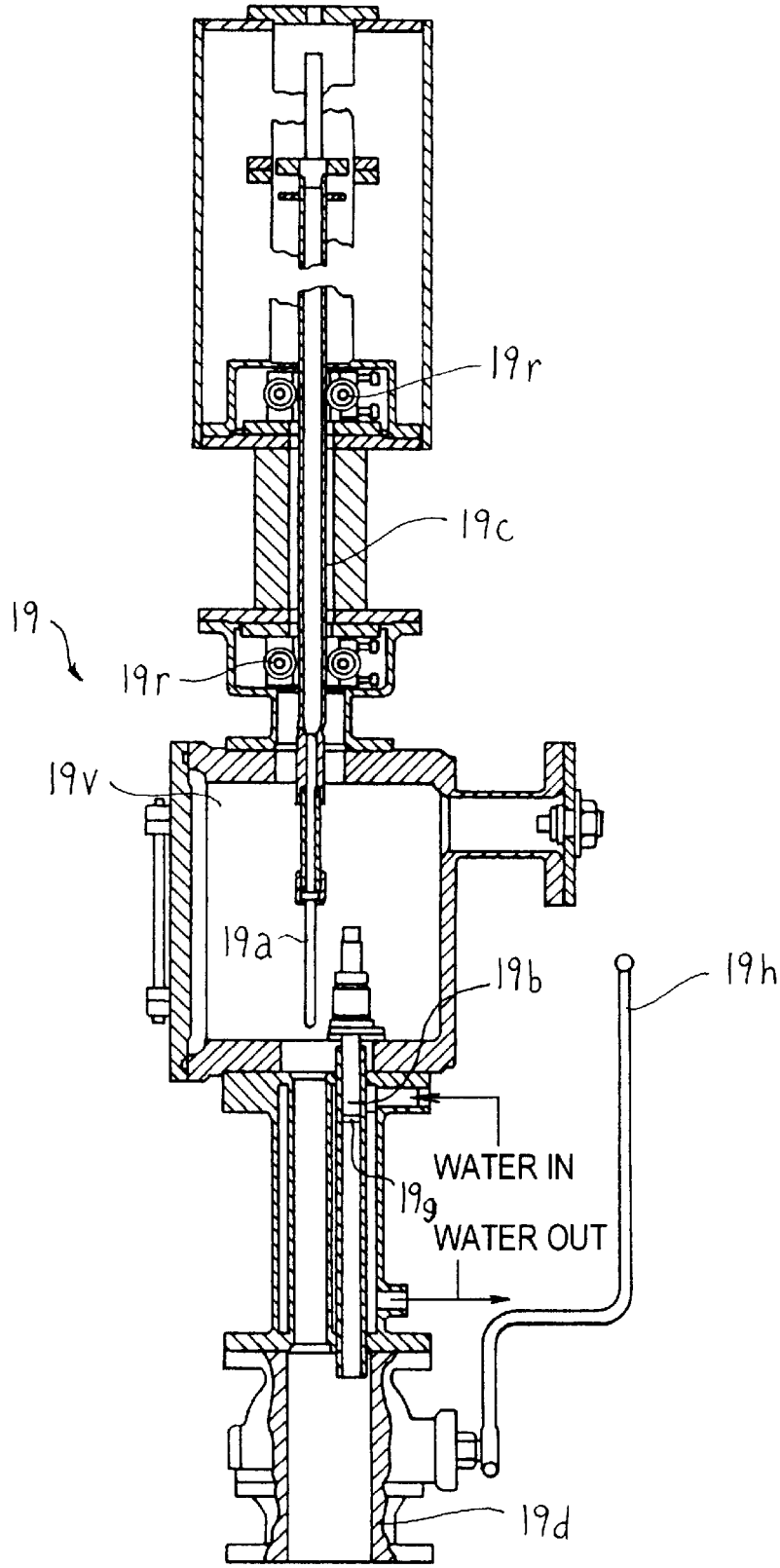
FIG. 5 is a longitudinal sectional view of the temperature measurement and control device to illustrate certain internal components shown in elevation.

A temperature measurement and control instrumentation device 19 is provided at the melting compartment 1, FIGS. 1 and 5, and comprises a multi-function device including a movable immersion thermocouple 19*a* for temperature measurement with maximum accuracy, combined with a stationary single color optical pyrometer 19*b* for temperature measurement with maximum ease and speed. The immersion thermocouple is mounted on a motor driven shaft 19*c* to lower the thermocouple into the molten metallic material in the crucible C when isolation valve 19*d* is opened to communicate to melting chamber 1. The shaft 19*c* is driven by electric motor 19*m*, FIG. 1, with its movement guided by guide rollers 19*r*. The thermocouple and pyrometer are combined in a single sensing unit to permit simultaneous measurement of metal temperature by both the optical and immersion thermocouple. The optical pyrometer is a single color system that measures temperature in the range of 1800 to 3200 degrees F. Because relatively minor issues such as a dirty sight glass impact the accuracy of optical readings, frequent calibration against immersion thermocouple readings is highly advisable for good process control. The thermocouple and pyrometer provide temperature signals to the CPU. A vacuum isolation chamber 19*v* can be opened after isolation valve 19*d* is closed by handle 19*h* to permit access for replacement of the immersion thermocouple tip and cleaning of the optical pyrometer sight glass 19*g* without breaking vacuum in the melting chamber 1. The envelope around the optical pyrometer is water cooled for maximum sensitivity and accuracy of temperature measurement. The melting vessel 5 is maintained directly below the device 19 to monitor and control the melt temperature during melting.

Figure 6:
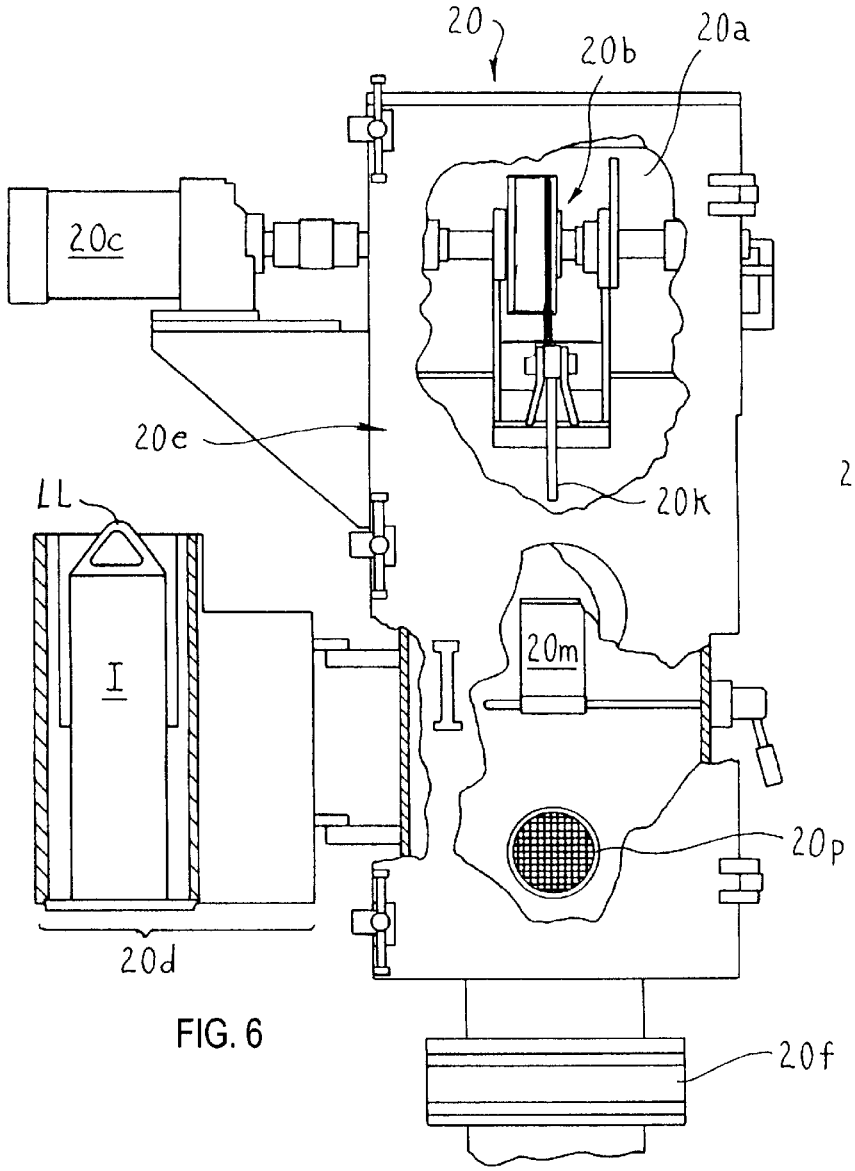
FIG. 6 is an elevational view, partially broken away, of the ingot charging system.
Figure 6A:
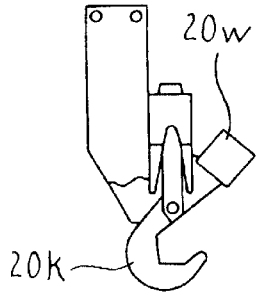
FIG. 6A is a partial elevational view of the hook.
Figure 8:
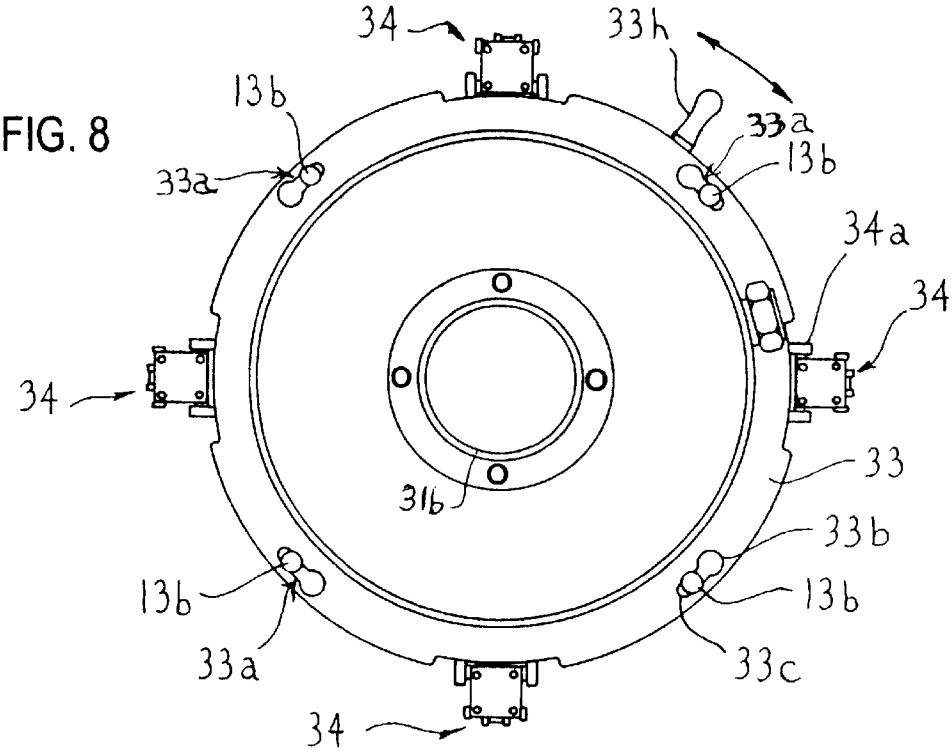
FIG. 8 is a plan view of the mold bonnet clamped on the mold base.

An ingot charging device 20 is illustrated in FIGS. 1 and 6, and 6A and is communicated to the melting compartment 1. This device is designed to permit simple and rapid introduction of additional metallic material (e.g. metal alloy) in the form of individual ingots I to the molten metallic material in the melting vessel 5 without the need to break vacuum in the melting chamber 1. This saves substantial time and avoids repeated exposure of the hot metal remaining in the crucible to contamination by either the oxygen or the nitrogen in the atmosphere. The device comprises a chamber 20*a*, chain hoist 20*b* driven by an electric motor 20*c* controlled by pendent operator hand control HP (FIG. 3), an ingot-loading assembly 20*d* hinged on the left side of the device in FIG. 6. Also shown are a door 20*e* hinged on the right side of the device and shown closed with cut away views, and an isolation valve 20*f* (called a load valve) which isolates or communicates the ingot feeder device to the melt chamber 1. With the load valve 20*f* closed, the pressure in chamber 20*a* can be brought up to atmospheric pressure so that the door 20*e* can be opened.

When the melt vessel 5 is ready to be charged, a preheated ingot I (preheated to remove any moisture from the ingot) is loaded onto the ingot-loading assembly 20*d*. The ingot-loading assembly 20*d* is then swung into the chamber 20*a*.

The chain hoist 20*b* is lowered into position so that hook 20*k* engages ingot loop LL. The hoist 20*b* is then raised to take the ingot I off from ingot-loading assembly 20*d*. The ingot-loading assembly 20*d* is swung out of the chamber 20*a*. The door 20*e* then is closed and sealed. At this point, vacuum is applied to the chamber 20*a* by vacuum pumping system 24*a* and 24*b* via vacuum conduits 24*c* and 24*d* (FIG. 3) connected to vacuum port 20*p* to bring the pressure down to the same vacuum as in the melt chamber or compartment 1. The load valve 20*f* then is opened to provide communication to the melting vessel 5 and the hoist 20*b* is lowered by motor 20*c* until the ingot I is just above crucible C in the melting vessel 5.

The hoist speed is then slowed down so that the ingot is preheated as it is lowered into the crucible C. When the ingot is in the crucible, the weight is automatically released from the chain hoist hook 20*k* by upward pressure from the crucible or molten metallic material in the crucible. A counterweight 20*w* on the hook 20*k*, FIG. 6A, causes the hook to be removed from the ingot I.

The hoist 20*b* is then raised and the load valve 20*f* is closed. The procedure is repeated to charge additional individual ingots into the melting vessel until the crucible C is fully charged. A sight-glass 20*g*, FIG. 1, cooperating with a mirror 20*m* permit viewing of the crucible to determine if it is properly charged.

When the melting vessel 5 has been pulled out of the melt chamber 1 for crucible cleaning, a full load of ingots can be placed in the crucible C before the melting vessel 5 is returned to the melt chamber 1. This eliminates the need to charge ingots one at a time for the first charge. After the melting vessel 5 is charged with ingots at the ingot charging device 20, it is moved to the instrumentation device 19 where the ingots are melted by energization of the induction coil 11.

Referring to FIG. 4, the melting vessel 5 includes a steel cylindrical shell 5*a* in which the water cooled, hollow copper induction coil 11 is received. The coil 11 is connected to leads 9*a*, 9*b* by threaded fittings FT5, FT6; and FT4, FT7. The coil 11 is shunted by upper and lower horizontal shunt rings 5*b*, 5*c* connected by a plurality (e.g. six) of vertical shunt tie-rod members 5*d* spaced apart in a circumferential direction between the upper and lower shunt rings 5*b*, 5*c* to concentrate the magnetic flux near the coil and prevent the transfer of the induction power to surrounding steel shell 5*a*. The tie rod members 5*d* are connected to the upper and lower shunt rings 5*a*, 5*b* by threaded rods (not shown). Upper and lower coil compression rings 5*e*, 5*f* and pairs of spacer rings 5*g*, 5*h* are provided above and below the respective shunt rings 5*b*, 5*c* for mechanical assembly.

The shunt rings 5*b*, 5*c* and tie-rod members 5*d* comprise a plurality of alternate iron laminations 5*i* and phenolic resin insulating laminations 5*p* to this end. A flux shield 5*sh* made of electrical insulating material is disposed beneath the lower-shunt ring 5*c*.

A closed end cylindrical (or other shape) ceramic crucible C is disposed in the steel shell 5*a* in a bed of refractory material 5*r* that is located inwardly of the induction coil 11. The ceramic crucible C can comprise an alumina or a zirconia ceramic crucible when nickel base superalloys are being melted and cast. Other ceramic crucible materials can be used depending upon the metal or alloy being melted and cast. The crucible C can be formed by cold pressing ceramic powders and firing.

The crucible is positioned in bed 5*r* of loose, binderless refractory particles, such as magnesium oxide ceramic particles of roughly 200 mesh size. The bed 5*r* of loose refractory particles is contained in a thin-wall resin-bonded refractory particulate coil grouting 5*l*, such as resin-bonded alumina-silica ceramic particles of roughly 60 mesh size, that is disposed adjacent the induction coil 11, FIG. 4.

The resin-bonded liner 5*l* is formed by hand application and drying, and then the loose refractory particulates of bed 5*r* are introduced to the bottom of the liner 5*l*. The crucible C then is placed on the bottom loose refractory particulates and the space between the vertical sidewall of the crucible C and the vertical sidewall of the liner 5*l* is filled in with loose refractory particulates of bed 5*r*.

An annular gas pressurization chamber-forming member 5*s* is fastened by suitable circumferentially spaced apart fasteners 5*j* and annular seal 5*v* atop the shell 5*a*. The member 5*s* includes an upper circumferential flange 5*z*, a large diameter circular central opening 501 and a lower smaller diameter circular opening 502 adjacent the upper open end of the crucible C and defining a central space SP. Water cooling passages 5*pp* are provided in the member 5*s*, which is made of stainless steel. The water cooling passages 5*pp* receive cooling water from water piping 5*p* contained within the hollow shaft 4*d*. The return water runs through a similar second water piping (not shown) located directly behind piping 5*p*.

Gas pressurization conduit 4*h* extends to the melting vessel 5 and is communicated to the central space SP of the member 5*s* and to the space around the outside of the melting induction coil 11 to avoid creation of a different pressure across the crucible C. Similarly, vacuum conduit 4*v* extends to the melting vessel 5 and is communicated to the central space SP of the member 5*s* and to the space around the outside of the melting induction coil 11 in a manner similar to that shown for conduit 4*h* in FIG. 4.

In practice of the invention, after the melting vessel 5 is charged with ingots at the ingot charging device 20, it is moved to the instrumentation device 19 where the ingots are melted in the melting compartment 1 under a full vacuum (e.g. 10 microns or less) by energization of the induction coil 11 to this end to form a bath of molten metallic material M in the crucible C. The vacuum conduit 4*v*, FIG. 4, and valve VV, FIGS. 1 and 3, are controlled to provide the vacuum in space SP and in the space around the outside of the induction coil 11 of the melting vessel 5 during melting.

When the ingots have been melted in the melting vessel 5, a preheated ceramic mold 15 is loaded into casting chamber or compartment 3 isolated by valve 2 from the melting compartment 1. The casting compartment 3 comprises an upper chamber 3*a* and lower chamber 3*b* having a loading/unloading sealable door 3*c*, FIG. 2. The lower chamber also includes a horizontally pivoting mold base support 14. The mold base support 14 comprises a vertical shaft 14*a* and a hydraulic actuator 14*b* on the shaft 14*a* for moving up and down and pivoting motion thereon. The shaft 14*a* is supported between upper and lower triangular plates 14*p* welded to a fixed apparatus frame and the side of the casting compartment 3. A support arm 14*c* extends from the actuator 14*b* and is configured as a fork shape to engage and carry a mold base 13.

Figure 2:
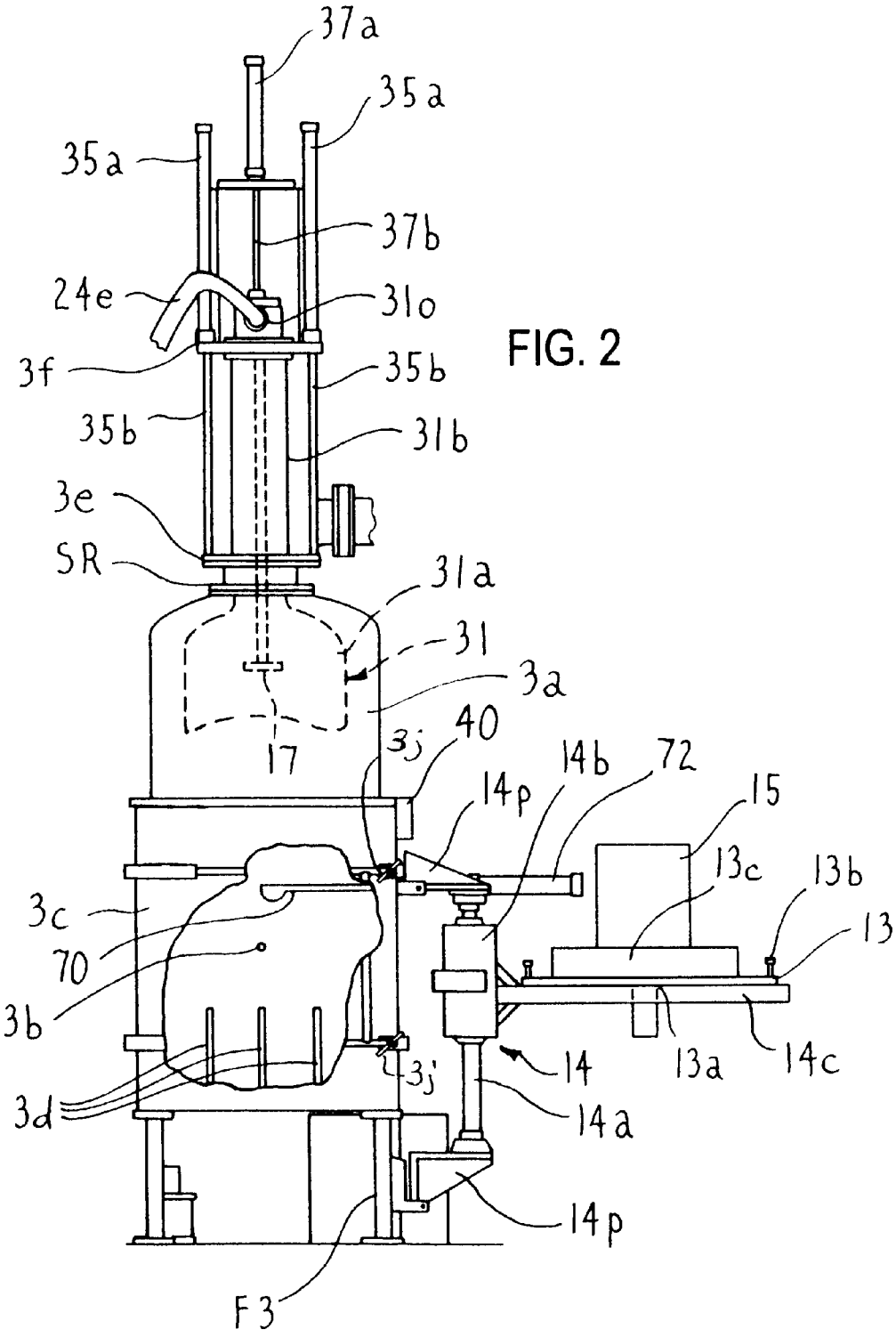
FIG. 2 is a partial elevational view of the casting compartment of FIG. 1.
Figure 7:
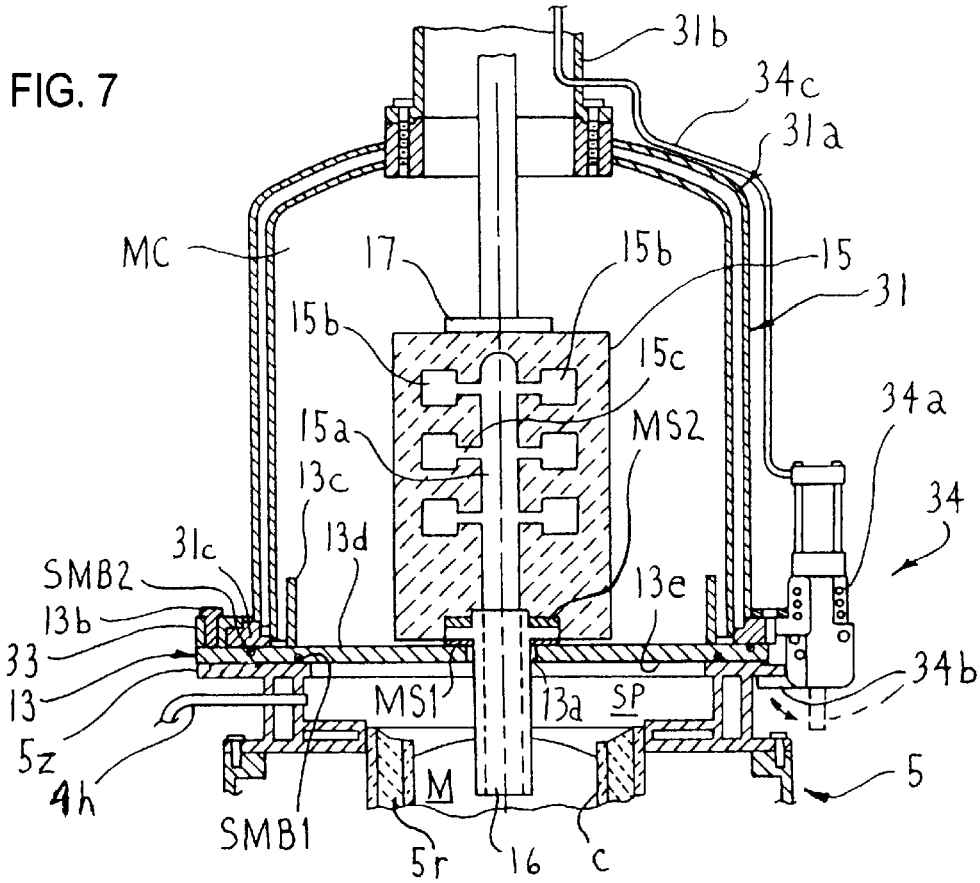
FIG. 7 is a diametral sectional view of mold bonnet on the mold base clamped on the melting vessel with certain componets shown in elevation.

The mold base 13, FIGS. 2 and 7, comprises a flat plate having a central opening 13*a* therethrough. The mold base 13 includes a plurality (e.g. 4) of vertical socket head shoulder locking screws 13*b* shown in FIGS. 2, 7, 8, 9B, and 9D, circumferentially spaced 90 degrees apart on the upwardly facing plate surface for purposes to be described. The mold base includes an annular short, upstanding stub wall 13*c* on upper surface 13d to form a containment chamber that collects molten metallic material that may leak from a cracked mold 15, FIG. 7.

An annular seal SMB1 comprising seal means is disposed between the mold base 13 and the flange 5*z* of the melting vessel 5. The seal is adapted to be sealed between the mold base 13 and the flange 5*z* of the melting vessel 5 to provide a gas tight-seal when the mold base 13 and melting vessel 5 are engaged as described below. One or multiple seals SMB1 can be provided between the mold base 13 and melting vessel 5 to this end. The mold base seal SMB1 can comprise a silicone material. The seal SMB1 typically is disposed on the lower surface 13e of the mold base 13 so that it is compressed when the mold base and melting vessel are engaged, although the seal SMB1 can alternately, or in addition, be disposed on the flange 5*z* of the melting vessel 5. A similar seal SMB2 is provided on the lower end flange 31*c* of a mold bonnet 31, and/or upper surface 13*d* of mold base 13, to provide a gas-tight seal between the mold base 13 and mold bonnet 31.

The mold base 13 is adapted to receive a preheated mold-to-base ceramic fiber seal or gasket MS1 about the opening 13*a* and a preheated ceramic mold 15 and a preheated snout or fill tube 16. The preheated mold 15 with fill tube 16 is positioned on the mold base 13 with the fill tube 16 extending through the opening 13*a* beyond the lowermost surface 13*e* of the mold base 13 and with the bottom of the mold 15 sitting on a second seal MS2, a ceramic fiber gasket which seals the mold 15 and the fill tube 16.

The ceramic mold 15 can be gas permeable or gas impermeable. A gas permeable mold can be formed by the well known lost wax process where a wax or other fugitive pattern is repeatedly dipped in a slurry of fine ceramic powder in water or organic carrier, drained of excess slurry, and then stuccoed or sanded with coarser ceramic particles to build up a gas permeable shell mold of suitable wall thickness on the pattern. A gas impermeable mold 15 can be formed using solid mold materials, or by the use in the lost wax process of finer ceramic particles in the slurries and/or the stuccoes to form a shell mold of such dense wall structure as to be essentially gas impermeable. In the lost wax process, the pattern is selectively removed from the shell mold by conventional thermal pattern removal operation such as flash dewaxing by heating, dissolution or other known pattern removal techniques. The green shell mold then can be fired at elevated temperature to develop mold strength for casting.

In practicing the invention, the ceramic mold 15 typically is formed to have a central sprue 15*a* that communicates to the fill tube 16 and supplies molten metallic material to a plurality of mold cavities 15*b* via side gates 15*c* arranged about the sprue 15*a* along its length as shown in U.S. Pat. Nos. 3,863,706 and 3,900,064, the teachings of which are incorporated herein by reference.

The support arm 14*c* loaded with mold base 13 and mold 15 thereon is pivoted into chamber 3 with the access door 3*c* open and is placed on support posts 3*d* fixed to the floor of the lower chamber 3*b*, FIG. 2.

Figure 9C:
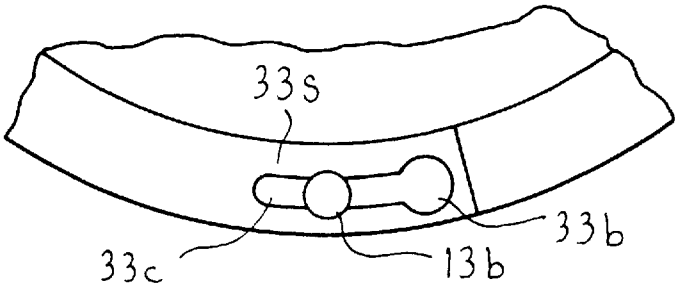
FIG. 9C is a partial plan view of the clamp ring on the mold bonnet in a clamped position.
Figure 9D:
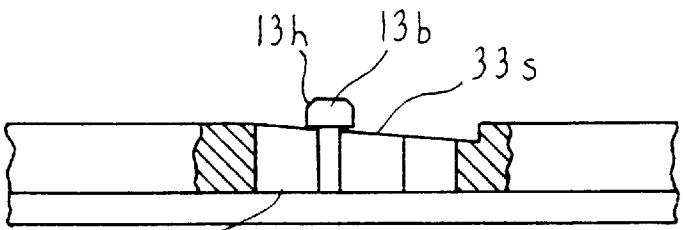
FIG. 9D is a partial elevational view, partially in section, of the clamp ring on the mold bonnet in the clamped position.
Figure 9A:
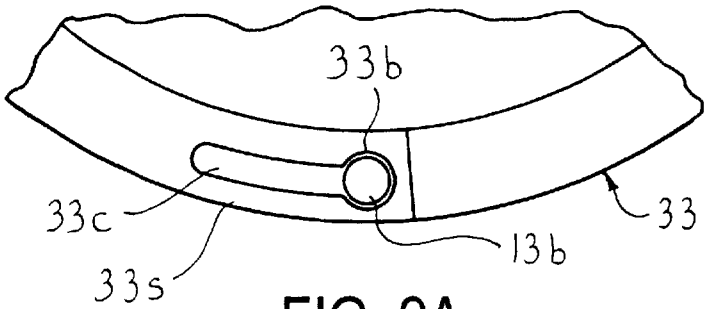
FIG. 9A is a partial plan view of the clamp ring on the mold bonnet in an unclamped position.
Figure 9B:
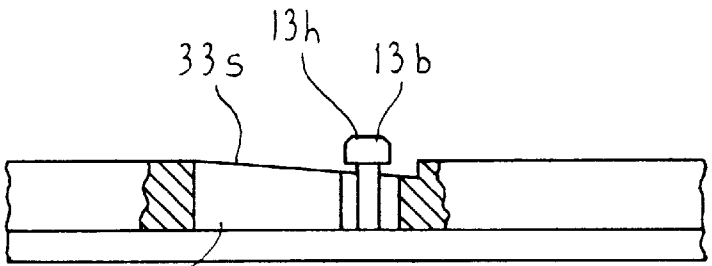
FIG. 9B is a partial elevational view, partially in section, of the clamp ring on the mold bonnet in the unclamped position.
Figure 10:
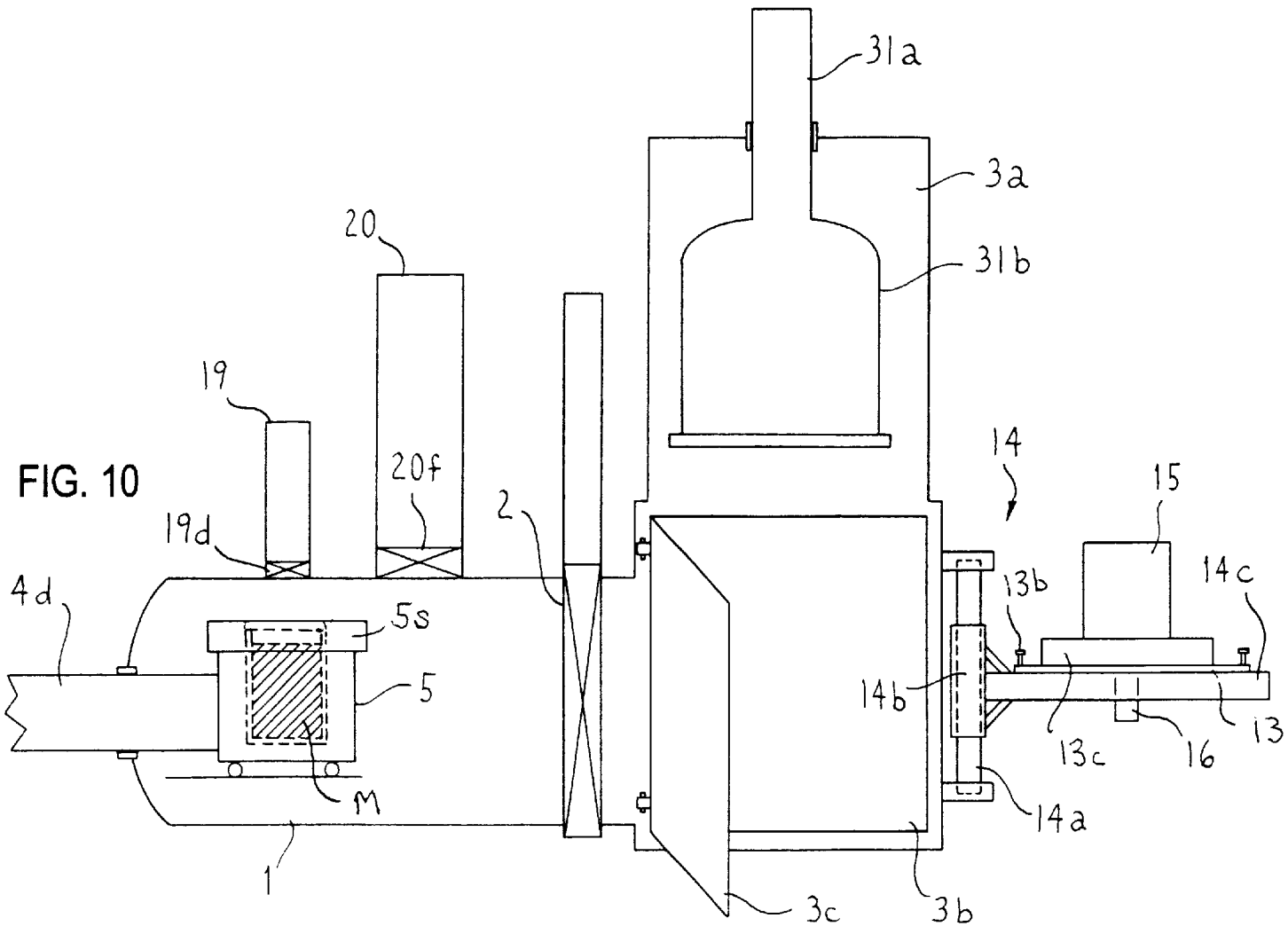
FIGS. 10 through 14 are schematic views of the apparatus showing successive method steps for practicing the invention.
Figure 11:
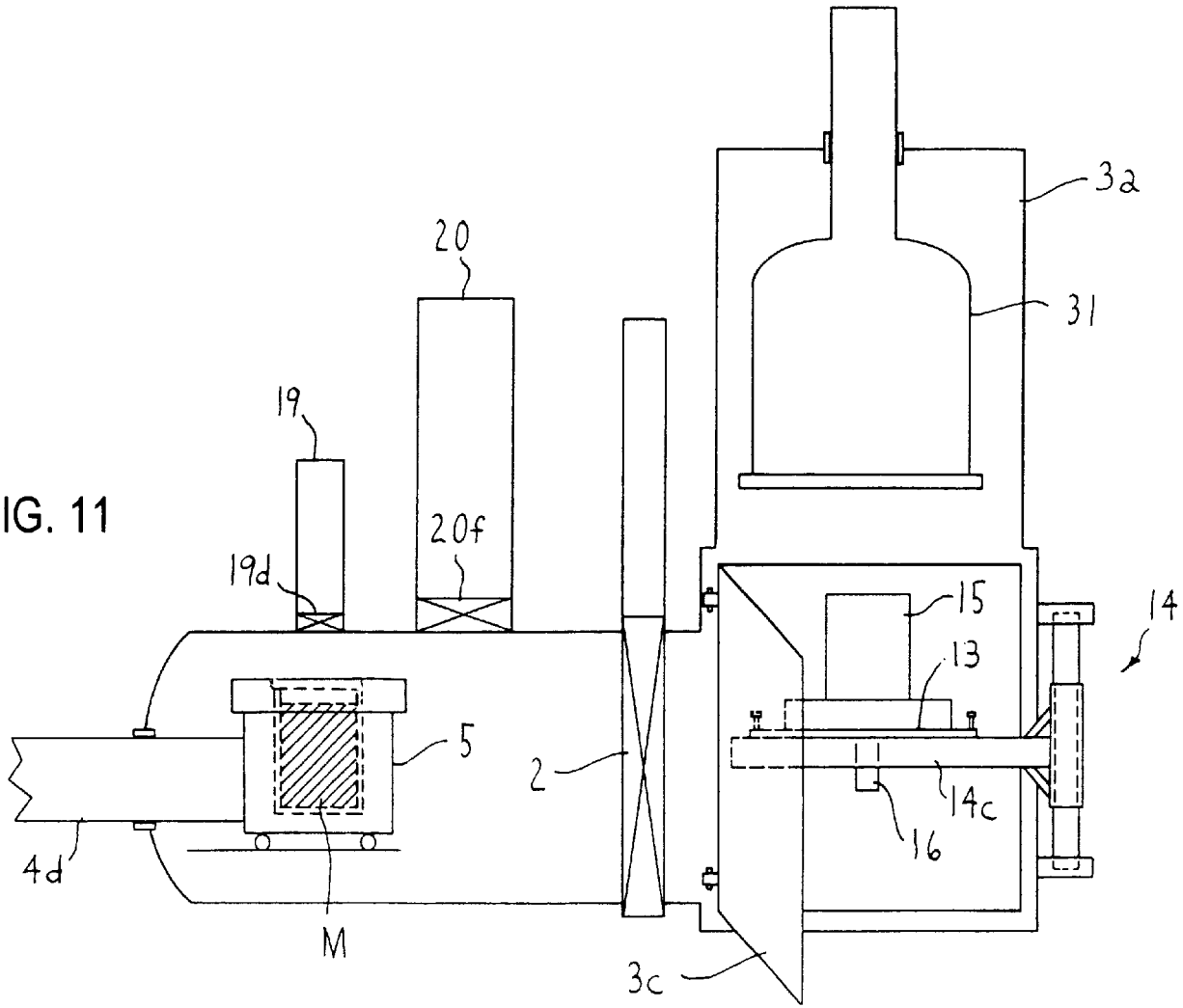
Figure 12:
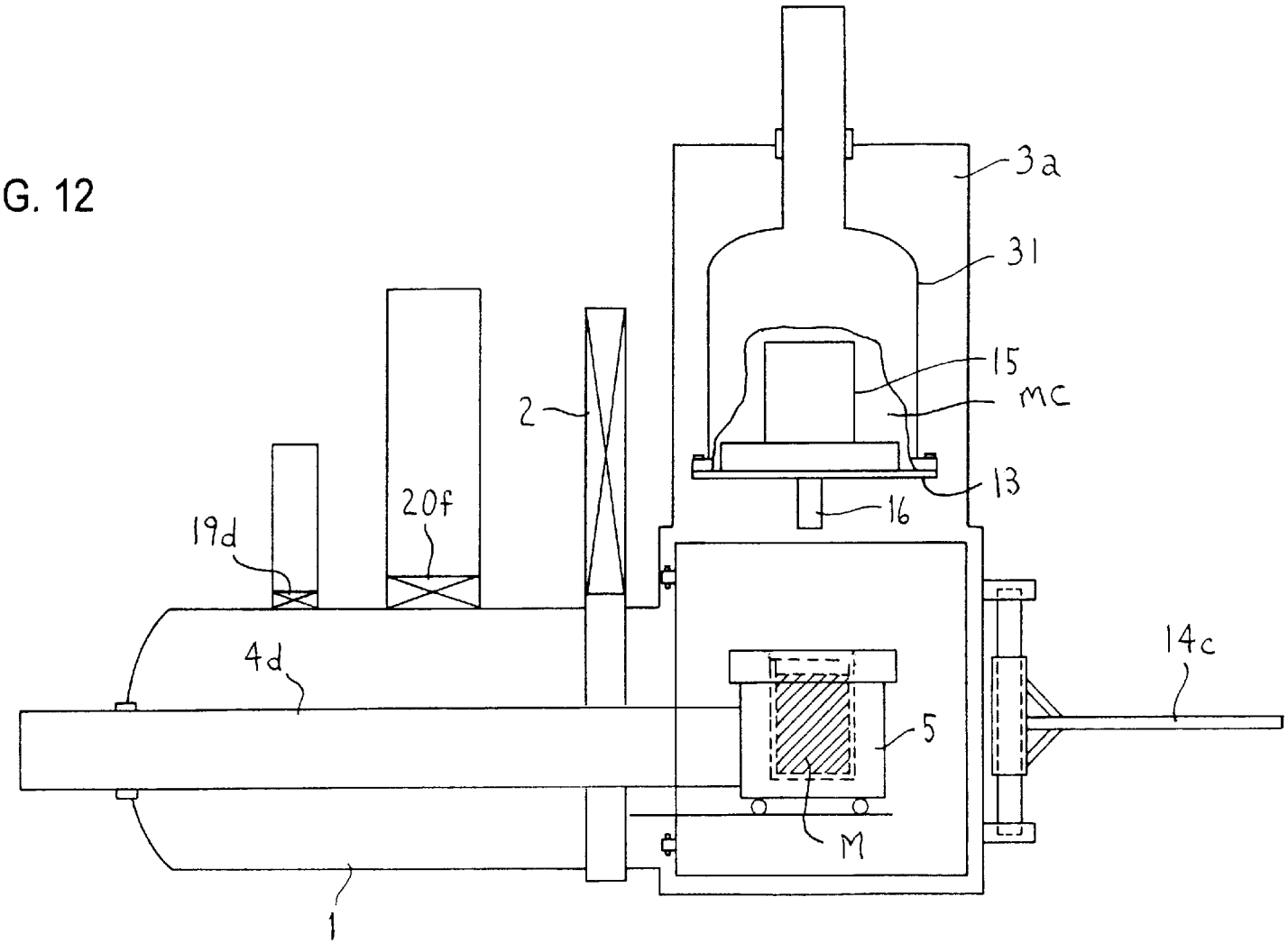

In the upper chamber 3*a* of the casting compartment is a double-walled, water cooled mold hood or bonnet 31 that is lowered onto the mold base 13 about the mold 15, FIG. 7. The mold bonnet 31 includes a lower bell-shaped region 31*a* that surrounds the mold 15 and an upper cylindrical tubular extension 31*b*, which passes through a vacuum-tight bushing SR to permit vertical movement of the bonnet 31. The lower region 31*a* includes lowermost circumferential end flange 31*c* adapted to mate with the mold base 13 with the seal SMB2 compressed therebetween to form a gas-tight seal, FIG. 7. The flange 31*c* includes a rotatable mold clamp ring 33 that has a plurality of arcuate slots 33*a* each with an enlarged entrance opening 33*b* and narrower arcuate slot region 33*c*. A cam surface 33*s* is provided on the clamp ring proximate each slot 33*a*. The mold clamp ring 33 is rotated by a handle 33*h* by the worker loading the combination of mold base 13/mold 15 into the casting compartment 3. In particular, the mold bonnet 31 is lowered onto mold base 13 such that locking screws 13*b* are received in the enlarged opening 33*a*, FIGS. 9A, 9B. Then, the worker rotates the ring 33 relative to the mold base 13 to engage cam surfaces 33*s* and the undersides of the heads 13*h* of locking screws 13*b*, FIGS. 9C, 9D, to cam lock mold base 13 against the bottom of mold bonnet 31.

The flange 31*c* has fastened thereto a plurality (e.g. 4) of circumferentially spaced apart, commercially available argon-actuated toggle lock clamps 34 (available as clamp model No. 895 from DE-STA-CO) that are actuated to clamp the melting vessel 5 and mold base 13 together during countergravity casting in a manner described below. The toggle lock clamps 34 receive argon from a source outside compartment 3 via a common conduit 34*c* that extends in hollow extension 31*b*, FIG. 7, and that supplies argon to a respective supply conduit (not shown) to each clamp 34. The toggle lock clamps include a housing 34*a* mounted by fasteners on the flange 31*c* and pivotable lock member 34*b* that engages the underside of circumferential flange 5*z* of the gas-pressurization. chamber-forming member 5*s*, FIG. 7 to clamp the melting vessel 5, mold base 13 and mold bonnet 31 together with seal SMB1 compressed between flange 5*z* and mold base 13 to provide a vacuum tight seal.

The hollow extension 31*b* of the mold bonnet 31 is connected to a pair of hydraulic cylinders 35 in a manner permitting the mold bonnet 31 to move up and down relative to the casting compartment 3. The hydraulic cylinder rods 35*b* are mounted on a stationary mounting flange 3*e* of chamber 3. The cylinder chambers 35*a* connect to the mold bonnet extension 31*b* at the flange 3*f*, which moves vertically with the actuation of the cylinders and raises or lowers the mold bonnet. The mold bonnet extension 31*b* moves through a vacuum-tight seal SR relative to the casting compartment 3.

A hydraulic cylinder 37 also is mounted on the upper end of the mold bonnet extension 31*b* and includes cylinder chamber 37*a* and cylinder rod 37*b* that is moved in the mold bonnet extension 31*b* to raise or lower the mold clamp 17. In particular, after the mold bonnet 31 is lowered and locked with the mold base 13, the cylinder 37 lowers the mold clamp 17 against the top of the mold 15 in the bonnet 31 to clamp the mold 15 and seals MS1 and MS2 against the mold base 13, FIG. 7.

The casting compartment 3 is evacuated using conventional vacuum pumping systems 24*a* and 24*b* shown in FIGS. 1 and 3. The casting compartment vacuum pumping systems 24*a* and 24*b* each include a pair of commercially available pumps to achieve desired negative (subambient) pressure; namely, a Stokes 1739HDBP system which is comprised of a rotary oil-sealed vacuum pump and a Roots-type blower to provide an initial vacuum level of roughly 50 microns and below in casting compartment 3 when isolation valve 2 is closed.

The vacuum pumping systems 24*a* and 24*b* singly or in tandem, individually or simultaneously, evacuate the upper chamber 3*a* of the casting compartment 3 via conduits 24*g*,

24*h*, the ingot charging device 20 described above via branch conduits 24*c*, 24*d* and the temperature measurement device 19 via a flexible conduit (not shown) connecting with conduit 24*d*. The vacuum pumping systems 24*a* and 24*b* also evacuate the mold bonnet extension 31*b* via a pair of flexible conduits 24*e* (one shown in FIG. 1) connected to branch conduit 24*f* and to ports 310 (one shown) on opposite diametral sides of the extension 31*b*, FIGS. 1 and 2, and the compartment 3*b* via conduit 24*h*. Conduits 24*e* are omitted from FIG. 3.

Operation of the apparatus detailed above will now be described with respect to FIGS. 10–14. After the melting vessel 5 is charged with ingots I at the ingot charging device 20, it is moved by shaft 4*d* to the instrumentation device 19 where the ingots are melted in the melting compartment 1 under a full vacuum (e.g. 10 microns or less) by energization of the induction coil 11 to input the required thermal energy, FIG. 10. When melting of the ingots in crcuible C is completed and the melt is brought to the required casting temperature as determined by temperature measurement device 19 and energization of induction coil 11, a preheated ceramic mold 15 with preheated fill tube 16 and preheated seals MS1 and MS2 are loaded on a mold base 13 on support arm 14*c*, FIG. 10. The support arm 14*c* then is pivoted to place the mold base 13 in the casting compartment 3 via the access door 3*c* with compartment 3 isolated by valve 2 from the melting compartment 1, FIG. 11. The mold bonnet 31 is in the raised position in upper chamber 3*a*.

After the mold base 13 is placed in the casting chamber 3*a*, the mold bonnet 31 is lowered by cylinders 35 to align the locking screws 13*b* in the slot openings 33*b* of the locking ring 33. The worker then rotates (partially turns) the locking ring 33 to lock the mold base 13 against the mold bonnet 31 by cam surfaces 33*s* engaging locking screw heads 13*h*. The mold clamp 17 is lowered by cylinder 37 to engage and hold the mold 15 and seals MS1, MS2 against the mold base 13. The mold base 13 and mold bonnet 31 form a mold chamber MC with mold 15 therein when clamped together. The clamped mold base/bonnet 13/31 then are lifted back into the upper chamber 3*a* of the casting compartment 3, and the mold base support arm 14*c* is swung away by the worker so that the casting compartment door 3*c* can be closed and vacuum tight sealed by closure and locking of the door using door clamps 3*j*, FIG. 12. Both the casting compartment 3 and the secondary mold chamber MC formed within mold base/bonnet 13/31 are evacuated by vacuum pumping systems 24*a*, 24*b* to a rapidly achievable, but very low initial pressure, such as for example 50 microns or less subambient pressure. Continuous pumping is maintained for approximately two full minutes, achieving a significantly more complete vacuum, such as 10 microns or less, than achievable with the process of U.S. Pat. Nos. 3,863,706 and 3,900,064 to remove virtually all gases, both those gases which are free within the casting compartment 3 and the mold chamber MC and those contained within porosity in shell mold 15 and core (not shown) if present in the mold, which gases could be potentially damaging to the reactive liquid metallic material (e.g. nickel base superalloy), if given the opportunity to combine with the more reactive elements in the metallic material to form oxides. If the mold 15 is gas impermeable, the opening to the mold through the snout or fill tube 16 provides access for evacuation.

When melting of the ingots in crucible C is completed and the melt is brought to the required casting temperature as determined by temperature measurement instrumentation 19 and after achieving the necessary vacuum level in the melting and casting compartments 1, 3, the isolation valve 2 is opened by its air actuated cylinder 2*a*. The melting vessel 5 with molten metallic material therein is moved on tracks 6 by actuation of cylinder 4 into the casting compartment 3 beneath the mold base/bonnet 13/31, FIG. 12. The tracks 6 provide both alignment and the mechanical stability necessary to carry the heavy, extended load.

The mold base/bonnet 13/31 then are lowered onto the melting vessel 5, FIGS. 7 and 13, such that the mold base 13 engages the flange 5*z* of the melting vessel 5 and is clamped to it with the argon-actuated toggle clamp locks 34 engaging the flange 5*z* with a 90 degree mechanical latch action. This motion accomplishes two things.

First, the vertical movement of the mold base/bonnet immerses the mold fill tube 16 into the molten metallic material M present as a pool in crucible C.

Second, engagement and clamping of the mold base 13 to the flange 5*z* of melting vessel 5 creates a sealed gas pressurizable space SP between the top surface of the molten metallic material M and the bottom surface 13*e* of the mold base 13. The seal SMB1 is compressed between the mold base 13 and flange 5*z* of the melting vessel to provide a as-tight seal to this end. This small (e.g. typically 1,000 cubic inches) space SP and space around the induction coil 11 of the melting vessel 5 is then pressurized through argon gas supply conduit 4*h* via opening of valve VA and closing vacuum conduit valve VV, while the compartments 1, 3 continue to be evacuated to 10 microns or less, thereby creating a pressure differential on the molten metallic material M in the crucible C required to force or "push" the molten metallic material upwardly through the fill tube 16 into the mold cavities 15*b* via the sprue 15*a* and side gates 15*c*. The argon pressurizing gas is typically provided at a gas pressure up to 2 atmospheres, such as 1 to 2 atmospheres, in the space SP. Maintenance of the positive argon pressure in the sealed space SP typically is continued for the specified casting cycle, during which time the metallic material in mold cavities 15*b* and a portion of the mold side gates 15*c* but typically not the sprue 15*a* has solidified. The melting vessel 5 is constructed to be pressure tight when sealed to the mold base 13 during the gas pressurization step using conduit 4*h* or vacuum tight during the evacuation step using vacuum conduit 4*v* described next.

After termination of the gas pressure by closing valve VA, the space SP and space around the induction coil 11 of the melting vessel 5 are evacuted using vacuum conduit 4*v* with valve VV open to equalize subambient pressure between sealable space SP and the compartments 1, 3. Remaining molten metallic material within the mold sprue 15*a* then can flow back into the crucible C and thereby be available, still in liquid form, for use in the casting of the next mold. The toggle lock clamps 34 are de-pressurized, permitting the mold base/bonnet 13/31 to be raised from the melting vessel 5, withdrawing the fill tube 16 from the molten metallic material in the crucible C. A drip pan 70 then is positioned by hydraulic cylinder 72 under the mold base 13 to catch any remaining drips of molten metallic material from the fill tube 16, FIG. 2.

Figure 14:
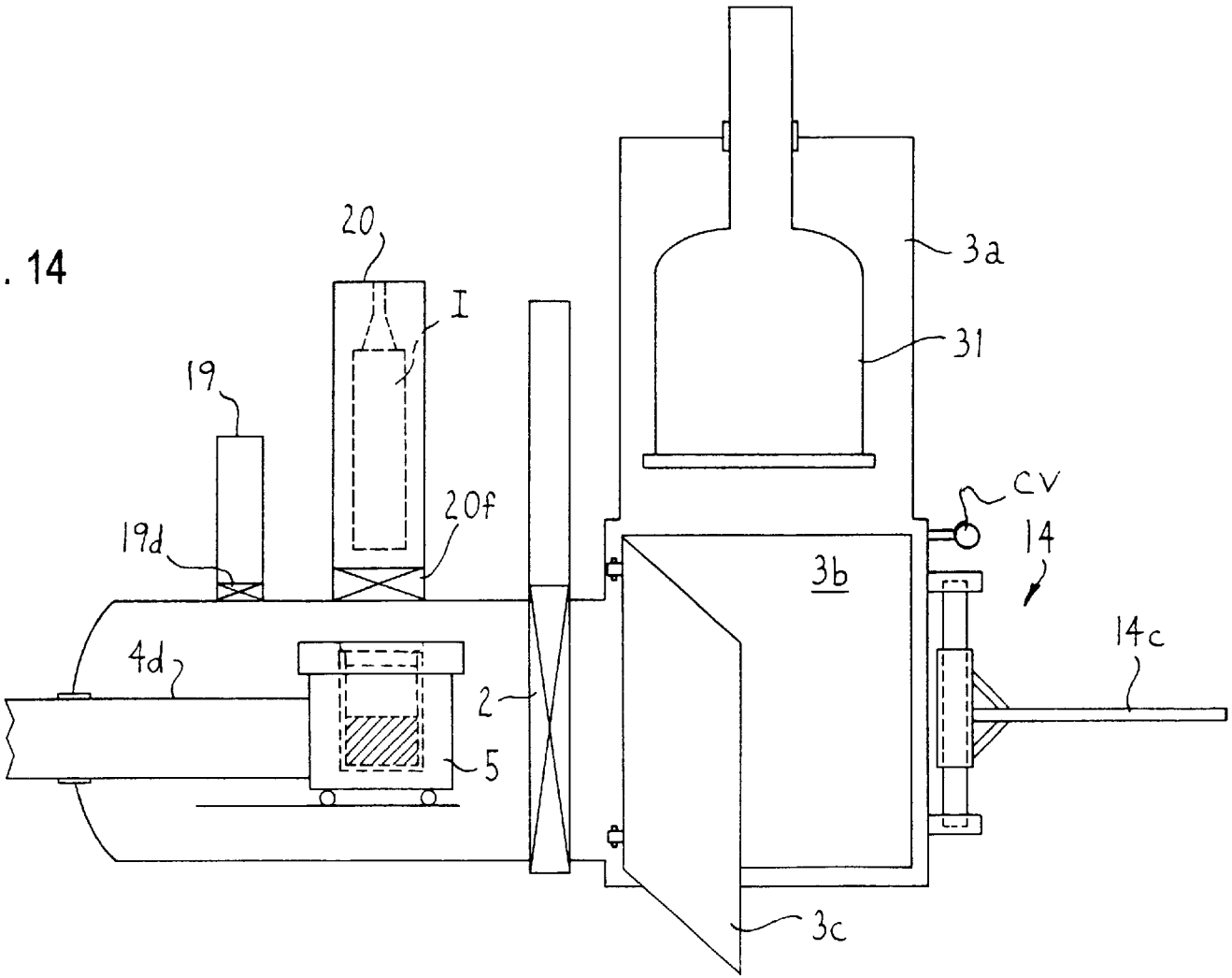

At this point in the casting cycle and as shown in FIG. 14, the melting vessel 5 is withdrawn into the melting compartment 1 and isolated from the casting compartment 3 by closing of isolation valve 2. This allows the vacuum in compartment 3 to be released by ambient vent valve CV, FIG. 14, to provide ambient pressure therein and the door 3*c* to be opened and the cast mold 15 on mold base 13 may be removed using support arm 14*c*. If there is no longer sufficient metallic material remaining in the crucible C to cast another mold, the crucible C is recharged with fresh master alloy using the charging mechanism 20, the new ingots are melted, and the total charge is again prepared for casting by establishing the defined melt casting temperature for the part to be cast. The casting of the molten metallic material into a new mold 15 is conducted in casting chamber 3 as previously described.

The invention is advantageous in that the mold 15 is filled with liquid metallic material while the mold is still under vacuum (e.g. 10 microns or less subambient pressure). There is, therefore, no resistance to the entry of metal into the mold cavities created by any sort of gas back pressure within the mold. It is no longer necessary that the mold wall be gas permeable to permit the escape of gases and the entry of metal. Entirely gas impermeable molds can be cast without difficulty, opening many new options with respect to the production of the mold itself, and making process combinations possible which were previously not practical. Further, as stated previously, substantially less interstitial gas, with the potential to form gas bubbles as a result of thermal expansion, remains in ceramic porosity, either in the mold wall or in preformed ceramic cores, such that casting scrap rates are reduced.

The molten metallic material returning from the sprue of the cast mold to the crucible is cleaner than similar recycled material from previous processes, because it, too, has been exposed to less evolved reactive gas during the casting cycle. This is revealed by the relative absence of accumulated dross floating on the surface of the metal remaining in the crucible following a similar number of casting cycles. Additionally, the gas pressurization of the small space above the melt which creates the pressure differential lifting the metal up into the mold can be accomplished more quickly, allowing complete molds to be filled faster, and therefore thinner cast sections to be filled. Greater consistency can be achieved between cavity fill rates at different heights on the same mold because of the elimination of available mold surface area and mold permeability as variables in the mechanics controlling the rate of pressure change within the mold. Pressure differentials greater than one atmosphere can be utilized in the practice of the invention. This permits the casting of taller components than could otherwise be produced due to the limitation on how high metal can be lifted by a pressure differential of not more than one atmosphere. It can also assist the feeding of porosity created during casting solidification as a result of the shrinkage which takes place in most alloys as they transition from liquid to solid. This increased pressure can force liquid to continue to progress through the solidification front to fill porosity voids that tend to be left behind. When applied to its full potential, the invention permits the use of smaller or fewer gates, resulting in additional cost reduction. It can also potentially eliminate the need for hot isostatic pressing (HIP'ing) as a means of microporosity elimination, achieving still further cost reduction.

Although the mold bonnet 31 is shown enclosing the mold 15 on mold base 13 and carrying the mold clamp 17, the mold bonnet may be omitted if the mold clamp 17 can otherwise be supported in a manner to clamp the mold 15 onto the mold base 13. That is, the mold 15 on the mold base 13 can communicate directly to casting compartment 3 without the intervening mold bonnet 31 in an alternative embodiment of the invention. Moreover, the invention envisions locating the melting compartment 1 below the casting compartment 3 in a manner described in U.S. Pat. No. 3,900,064 such that the melting vessel 5 is moved upwardly into the casting compartment to engage and seal with a mold base 13 positioned therein to form the gas pressurizable space to countergravity molten metallic material into a mold on the mold base.

Although certain specific embodiments of the invention have been described above, those skilled in the art will appreciate that the invention is not so limited and that changes, modifications and the like can be made thereto without departing from the scope of the invention as set forth in the appended claims.

We claim:

1. Method of countergravity casting a metallic material, comprising:

a) melting the metallic material under subambient pressure in a melting vessel, b) providing a mold under subambient pressure on a mold base with a fill tube extending through an opening in said mold base, c) relatively moving said melting vessel and said mold base while providing subambient pressure about said melting vessel and said mold to immerse an opening of said fill tube in the melted metallic material in said melting vessel and to engage said melting vessel and said mold base with means for sealing therebetween and with the engaged mold base and melting vessel together enclosing a sealed gas pressurizable space that is located above the melted metallic material and below said mold base exteriorly of said fill tube and in communication with said melted metallic material such that gas pressure provided in said space is exerted on said melted metallic material, and d) gas pressurizing said space while subambient pressure is provided about said melting vessel and about and in said mold to establish a pressure on the melted metallic material to force it upwardly through said fill tube into said mold.

2. The method of claim 1 including the further step after step d) of terminating said gas pressurizing and equalizing subambient pressure between said mold and said sealable space.

3. The method of claim 2 including the further step of relatively moving said melting vessel and said mold base to disengage said melting vessel and said mold base to withdraw said fill tube from the melted metallic material in said melting vessel.

4. The method of claim 1 wherein said means for sealing is disposed on said mold base.

5. The method of claim 1 including engaging an upper surface of said melting vessel and a bottom surface of said mold base with said means for sealing therebetween.

6. The method of claim 1 including clamping said mold base and said melting vessel together.

7. The method of claim 1 including clamping said mold on said mold base.

8. The method of claim 7 including disposing a mold bonnet on said mold base with a movable mold clamp in said bonnet clamping said mold on said mold base.

9. The method of claim 1 wherein said metallic material is melted in a melting vessel disposed in a melting chamber evacuated to subambient pressure.

10. The method of claim 9 wherein said mold on said mold base is disposed in a casting chamber evacuated to subambient pressure.

11. The method of claim 10 including moving said melting vessel to said casting chamber beneath said mold base.

12. The method of claim 11 including lowering said mold base to immerse said opening of said fill tube in the melted metallic material in said melting vessel and to engage said melting vessel and said mold base with said means for sealing therebetween.

13. The method of claim 1 wherein said metallic material comprises a nickel base superalloy.

14. The method of claim 1 wherein an annular surface between the mold base and melting vessel forms an outer periphery of said space.

15. The method of claim 1 wherein said melting vessel and said mold base with said mold thereon are relatively moved in a casting compartment at subambient pressure and wherein said space enclosed by said melting vessel and said mold base in said casting compartment is subjected to said gas pressurizing while said casting compartment is at the subambient pressure.

16. Method of countergravity casting a metallic material, comprising:

a) melting the metallic material under subambient pressure in a melting vessel, b) providing a mold on a mold base in a casting compartment at subambient pressure with a fill tube of said mold extending through an opening in said mold base, c) relatively moving said melting vessel and said mold base with said mold thereon in the casting compartment at subambient pressure to immerse an opening of said fill tube in the melted metallic material in said melting vessel and to engage said melting vessel and said mold base with means for sealing therebetween and with the engaged mold base and melting vessel enclosing a gas pressurizable space in the casting compartment above the melted metallic material and below the mold base, and d) gas pressurizing said space while subambient pressure is provided in said casting compartment about said melting vessel and about and in said mold to establish a pressure on the melted metallic material to force it upwardly through said fill tube into said mold.

17. Method of countergravity casting a metallic material, comprising:

a) melting the metallic material under subambient pressure in a melting vessel, b) providing a mold on a mold base in a casting compartment at subambient pressure with a fill tube of said mold extending through an opening in said base, c) relatively moving said melting vessel and said mold base with said mold thereon in the casting compartment at subambient pressure to immerse an opening of said fill tube in the melted metallic material in said melting vessel and to engage an upper surface of said melting vessel and a lower surface of said mold base with means for sealing between said upper surface and said lower surface and with the mold base and the melting vessel enclosing a gas pressurizable space in the casting compartment above the melted metallic material and below the mold base with said lower surface of said mold base directly facing said melted metallic material, and d) gas pressurizing said space while subambient pressure is provided in said casting compartment about said melting vessel and about and in said mold to establish a pressure on the melted metallic material to force it upwardly through said fill tube into said mold.

18. The method of claim 17 including cooling a region of said melting vessel that forms said upper surface thereof.

19. Method of countergravity casting a metallic material, comprising:

a) melting the metallic material under subambient pressure in a melting vessel, b) providing a mold on a mold base in a casting compartment at subambient pressure with a fill tube of said mold extending through an opening in said mold base, c) relatively moving said melting vessel and said mold base with said mold thereon in the casting compartment at subambient pressure to immerse an opening of said fill tube in the melted metallic material in said melting vessel and to engage an upper surface of an annular flange on said melting vessel and a lower surface of said mold base with means for sealing between said upper surface and said lower surface so as to enclose a gas pressurizable space in the casting compartment above the melted metallic material and below said mold base with said lower surface of said mold base directly facing said melted metallic material and with said annular flange enclosing an outer periphery of said space, and d) gas pressurizing said space while subambient pressure is provided in the casting compartment about said melting vessel and about and in said mold to establish a pressure on the melted metallic material to force it upwardly through said fill tube into said mold.

20. The method of claim 19 including cooling said flange on said melting vessel by flowing a coolant through said flange.

21. Method of countergravity casting a metallic material, comprising:

a) melting the metallic material under subambient pressure in a melting vessel, b) disposing a mold on a mold base in a casting compartment at subambient pressure with a fill tube of said mold extending through an opening in said mold base, c) relatively moving said melting vessel and said mold base with said mold thereon in said casting compartment at subambient pressure to immerse an opening of said fill tube in the melted metallic material in said melting vessel and to engage said melting vessel and said mold base with means for sealing therebetween and with the engaged mold base and melting vessel enclosing a sealed gas pressurizable space in said casting compartment above the melted metallic material and below said base, including clamping said melting vessel and said mold base together in said casting compartment, and e) gas pressurizing said space while subambient pressure is provided in said casting compartment about said melting vessel and about and in said mold to establish a pressure on the melted metallic material to force it upwardly through said fill tube into said mold.

22. The method of claim 21 wherein an upper annular flange on said melting vessel is clamped to said lower surface of said mold base and forms an outer periphery of said space.

23. Method of countergravity casting a metallic material, comprising:

a) engaging a melting vessel and a mold base having a mold thereon in a casting compartment at subambient pressure to immerse an opening of a fill tube of said mold in melted metallic material in said melting vessel, said mold base and said melting vessel enclosing a gas pressurizable space located in the casting compartment above the melted metallic material and below the mold base, and b) gas pressurizing said space while said subambient pressure is provided in the casting compartment about said melting vessel and about and in said mold to establish a pressure on the melted metallic material to force it upwardly through said fill tube into said mold.

* * * * *